US006976891B1

(12) United States Patent
Mele

(10) Patent No.: US 6,976,891 B1
(45) Date of Patent: Dec. 20, 2005

(54) UNDERWATER SOUND AND BUBBLES FOR POWERED WATERCRAFT

(75) Inventor: Peter Mele, 1505 White Church Rd., P.O. Box 533, Crown Point, NY (US) 12928

(73) Assignee: Peter Mele, Crown PT, NY (US)

( * ) Notice: Subject to any disclaimer, the term of this patent is extended or adjusted under 35 U.S.C. 154(b) by 0 days.

(21) Appl. No.: 10/862,612

(22) Filed: Jun. 7, 2004

Related U.S. Application Data

(63) Continuation-in-part of application No. 10/236,225, filed on Sep. 5, 2002, now Pat. No. 6,755,702.

(51) Int. Cl.[7] ..... B63H 11/00
(52) U.S. Cl. ..... 440/38; 114/151
(58) Field of Search ..... 440/38, 40, 42, 440/43, 44, 47; 114/151; 441/65, 130, 132; 446/15, 16

(56) References Cited

U.S. PATENT DOCUMENTS

| | | | | |
|---|---|---|---|---|
| 3,372,667 | A * | 3/1968 | Sweet | 440/40 |
| 3,933,113 | A * | 1/1976 | Dornak, Jr. | 440/42 |
| 4,115,888 | A * | 9/1978 | Sievers | 440/38 |
| 6,250,977 | B1 * | 6/2001 | Ness | 440/38 |
| 6,520,814 | B1 * | 2/2003 | Elias et al. | 440/38 |

* cited by examiner

*Primary Examiner*—Lars A. Olson

(57) ABSTRACT

Sound and bubble producing apparatus formed by a channeled member having an air inlet and outlet immersible in a body of water, with said outlet accompanied by structure that casuse air bubbles and sound to be emitted from said outlet when immersed the body of water.

19 Claims, 6 Drawing Sheets

Air
42
41
B
B
Water
B
B
A
A
5A
5A 42
41
44
5B
5B 42
41
44

UNDERWATER SOUND AND BUBBLES FOR POWERED WATERCRAFT

This is a continuation-in-part of Ser. No. 10/236,225, filed Sep. 5, 2002, now U.S. Pat. No. 6,755,702. The invention relates to the generation of sound and bubbles by powered watercraft, and more particularly, to recreational watercraft that can produce a jet sound and air bubbles during propulsion.

BACKGROUND OF THE INVENTION

Conventional watercraft produce sound effects by internal combustion engines or battery operated electric motors to provide propulsion. However, other watercraft, such as sail boats, do not produce such sound effects, which often are of assistance in alerting swimmers and aquatic animals to the presence of moving watercraft.

In addition, it often is desirable to provide some indication of the directions in which watercraft are moving. This can provide a further alert to swimmers seeking to avoid contact with the watercraft.

Accordingly, it is an object of the invention to provide sound effects, which can alerting swimmers and aquatic animals to the presence of moving watercraft.

Another object of the invention is to provide sound effects without the need for complex mechanical equipment.

A still other object is to provide sound effect to signal the motion of relatively soundless watercraft, such as sailboats.

A further object of the invention is to provide the generation of a stream of bubbles indicating the direction of motion of moving watercraft.

A still further object is achieve sound effects and bubble generation in a relatively inexpensive fashion by apparatus which is simple to operate.

Still another object of the invention is to provide a novel accessory for the underwater generation of noise and the production of bubbles.

Yet another object of the invention is to provide watercraft propulsion that is accompanied by jet sound and the production of bubbles that indicate the direction of forward and turning movements.

Still another object of the invention is to provide watercraft with sound generating and bubble producing equipment which is relatively simple in both operation and construction.

It also is an object of the invention to provide a water jet infused with air bubbles as a directional indicator.

SUMMARY OF THE INVENTION

In accomplishing the foregoing and related objects, the invention provides for a channeled member having an inlet for air and an outlet immersible in a body of water. A mechanism associated with the channeled member causes air from the inlet to escape from the outlet when the outlet is immersed in the body of water, and the channeled member is propelled with its outlet is immersed in the water.

In accordance with one aspect of the invention the channeled member is a tube extending from the interior of a watercraft through a bottom thereof. The mechanism associated with the channeled member surrounds the outlet for causing air from the inlet to escape from the outlet when it is immersed and propelled in the water.

The mechanism associated with the channeled member can produce a vacuum effect at the outlet for causing air from the inlet to escape from the outlet when immersed in the body of water. The channeled member can take the form of a bent tube with the outlet angularly positioned in relation to the inlet. The bent tube can have its outlet orthogonally positioned in relation to its inlet.

In accordance with another aspect of the invention, the mechanism for permitting the channeled member to be propelled with the outlet immersed in a body of water can be pressure applied from an aquatic source, with the pressure provided by the movement of the channeled member through the body of water. Alternatively, movement of the channeled member through the body of water can be provided by wind power or mechanical power.

In a method of the invention for producing a sound effect, the steps include (a) providing a channeled member having an air inlet and an outlet; (b) associating, with the channeled member, a mechanism for causing air from the inlet to escape from the outlet when the outlet is immersed in a body of water; (c) immersing the outlet of the channeled member in the body of water; and (d) propelling the channeled member with the outlet immersed in the body of water.

The method further includes the step of propelling the channeled member by wind power, aquatic power, or mechanical power.

The method also includes the step of orthogonally positioning the outlet in the form of a tube in relation to said inlet, the step of flaring the end of the outlet, and the step of forming a venturi with respect to the outlet, which can be surrounded by the venturi to reduce water pressure at the outlet.

In a method of the invention for producing a bubble effect, the steps include (a) providing a channeled member having an air inlet and an outlet; (b) associating, with the channeled member, a mechanism for causing air from the inlet to escape from the outlet in the form of bubbles when the outlet is immersed in a body of water; (c) immersing the outlet of the channeled member in said body of water; and (d) propelling the channeled member with the outlet immersed in the body of water.

DESCRIPTION OF THE DRAWINGS

Other aspects of the invention will become apparent after considering several illustrative embodiments, taken in conjunction with the drawings in which.

DETAILED DESCRIPTION

Figure 1:
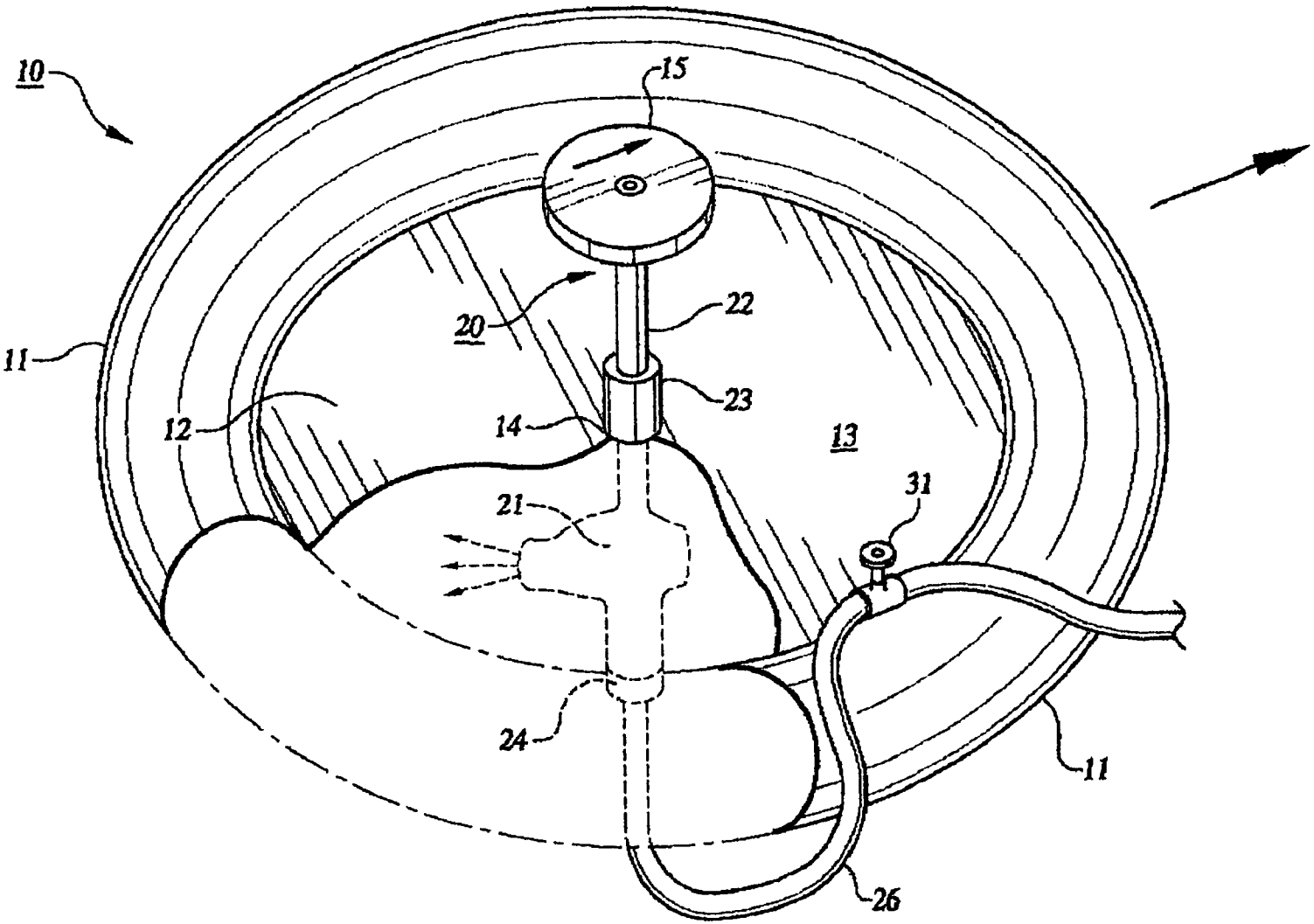
FIG. 1 is a partial perspective view of a watercraft with the controller of the invention for forming underwater sound effects and bubbles.

With reference to the drawings, a watercraft 10 may be of any convenient size and configuration, with the configuration of FIG. 1 having been found to be relatively stable in operation when occupied by one or a few persons.

The watercraft 10 may be of any convenient construction and formed from such materials as foamed or expanded polymers, expanded styrene, or vacuum formed sheet plastic joined together to form a hollow hull.

In the configuration shown, the watercraft 10 has a doughnut shaped surface 11 and a bottom 12 that may be flat and clear for display of items below the bottom.

The watercraft 10 is provided with a passenger compartment 13 and a controller 20 mounted at a position 14 of the passenger compartment 13. The mounting position 14 for the controller 20 may be at the center of the passenger compartment 13, or it may off-center.

Figure 2:
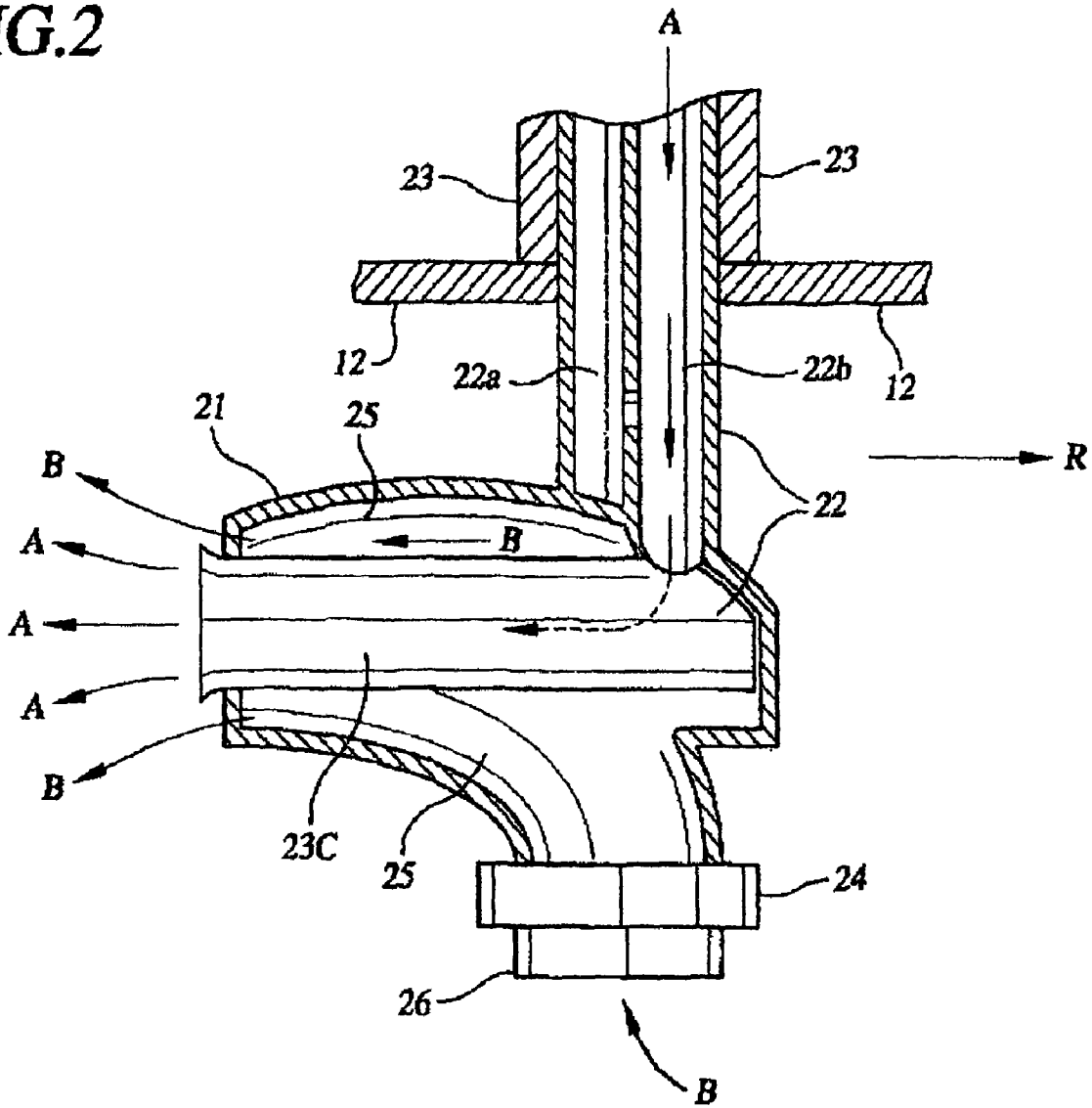
FIG. 2 is a view, partially in section, showing details for the controller of FIG. 1.

The controller 20, shown in detail in FIG. 2, has an outlet nozzle 21 that is connected to a channeled inlet member 22 which extends upwardly into the craft 10 through the flat bottom 12. A retention bushing 23 in contact with the flat bottom 12 surrounds the inlet member 22 and holds it in place.

The channeled inlet member 22 shown in FIG. 2 is tubular, but other forms may also be employed. Extending from an inlet I are two inlet channels 22*a* and 22*b* by which air, or other gaseous fluid, can flow, as indicated by arrows A, into an outlet channel 22*c*. When there is fluid flow, as indicated by the arrows B, out of the nozzle 21, a partial vacuum is formed at the end of the nozzle 21, drawing air from the outlet O of the outlet channel 22*c*. In effect, the nozzle 21 acts as a mechanism for causing air entering at the inlet I to escape from the outlet O when the channeled member 22 is being propelled through the water B. This air-flow produces a jet sound and a visual display of exhaust bubbles.

It is to be noted that the nozzle 21 can be shaped to act as a venturi by speeding the outward flow of water as it exits the nozzle because a large volume of water is being forced from the narrow opening between the outlet O of the channeled member 22 and the nozzle 21.

When the watercraft 10 is used in a still or relatively still body of water, propulsion and fluid flow B are achieved by attaching a hose 26 to a swivel joint 24 of the nozzle 21 to allow water from a source (not shown) connected to the hose 26 to enter the outlet channel 25 which surrounds the inlet channel extension 23*c*. Accordingly, water flow, indicated by the arrows B, emerges simultaneously from the nozzle 21 with air flow.

The motion of the craft 10 depends upon the orientation of the nozzle 21. In the position shown in FIGS. 1 and 2, with the nozzle 21 extending to the left, the motion of the craft 10 is to the right, as indicated by the arrow R in FIGS. 1 and 2. To permit changes of direction a removable steering wheel 15 is attached to the inlet member 22 as shown in FIG. 1.

In order to control the fluid flow into the outlet channel 25, the hose 26 can include a valve 31 mounted on the craft 10, also as shown in FIG. 1. Otherwise it is necessary to use the valve at the connection of the hose 26 to the pressure source (not shown).

Figure 3A:
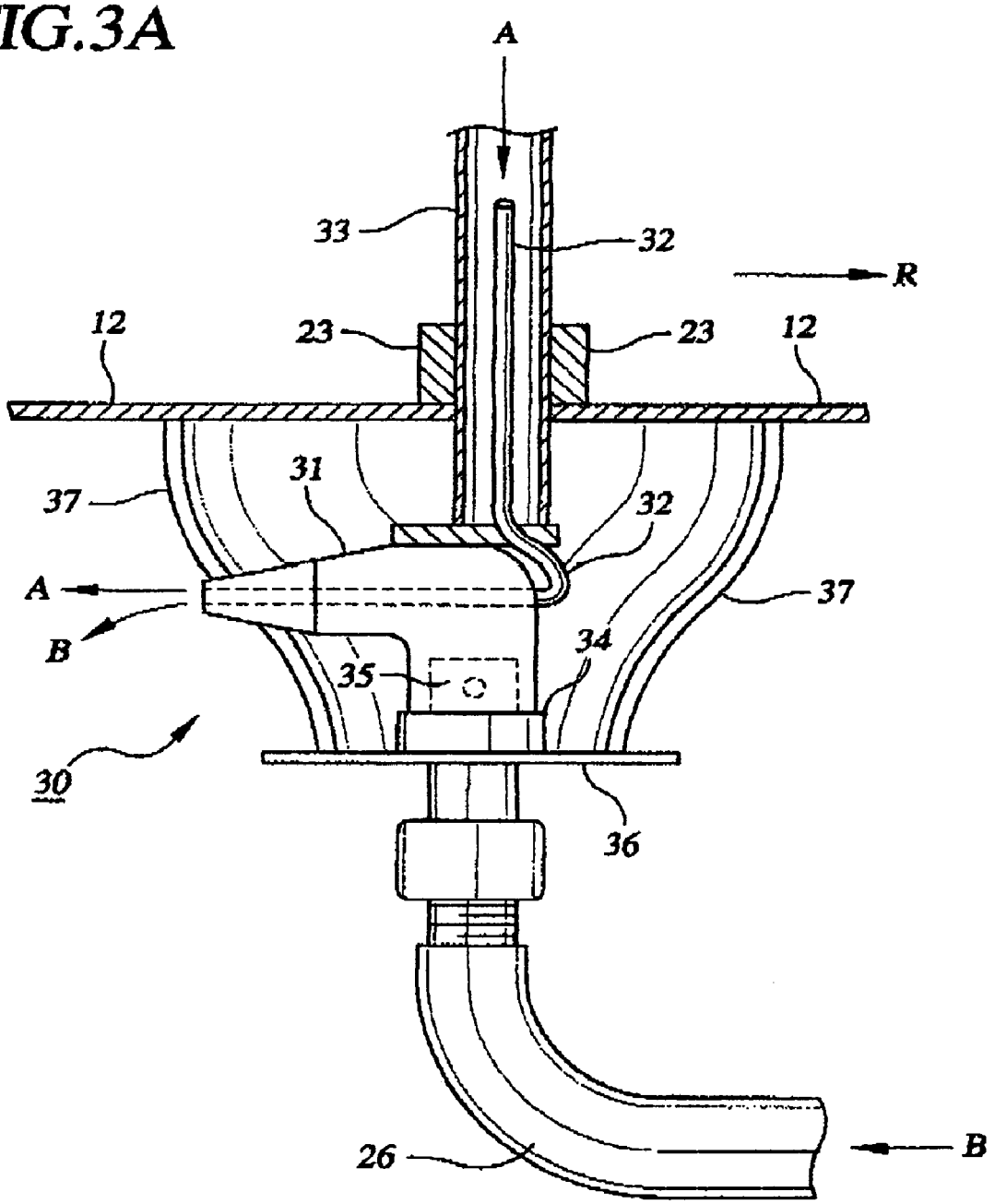
FIG. 3A is a view, partially in section, of an alternative controller in accordance with the invention.
Figure 3B:
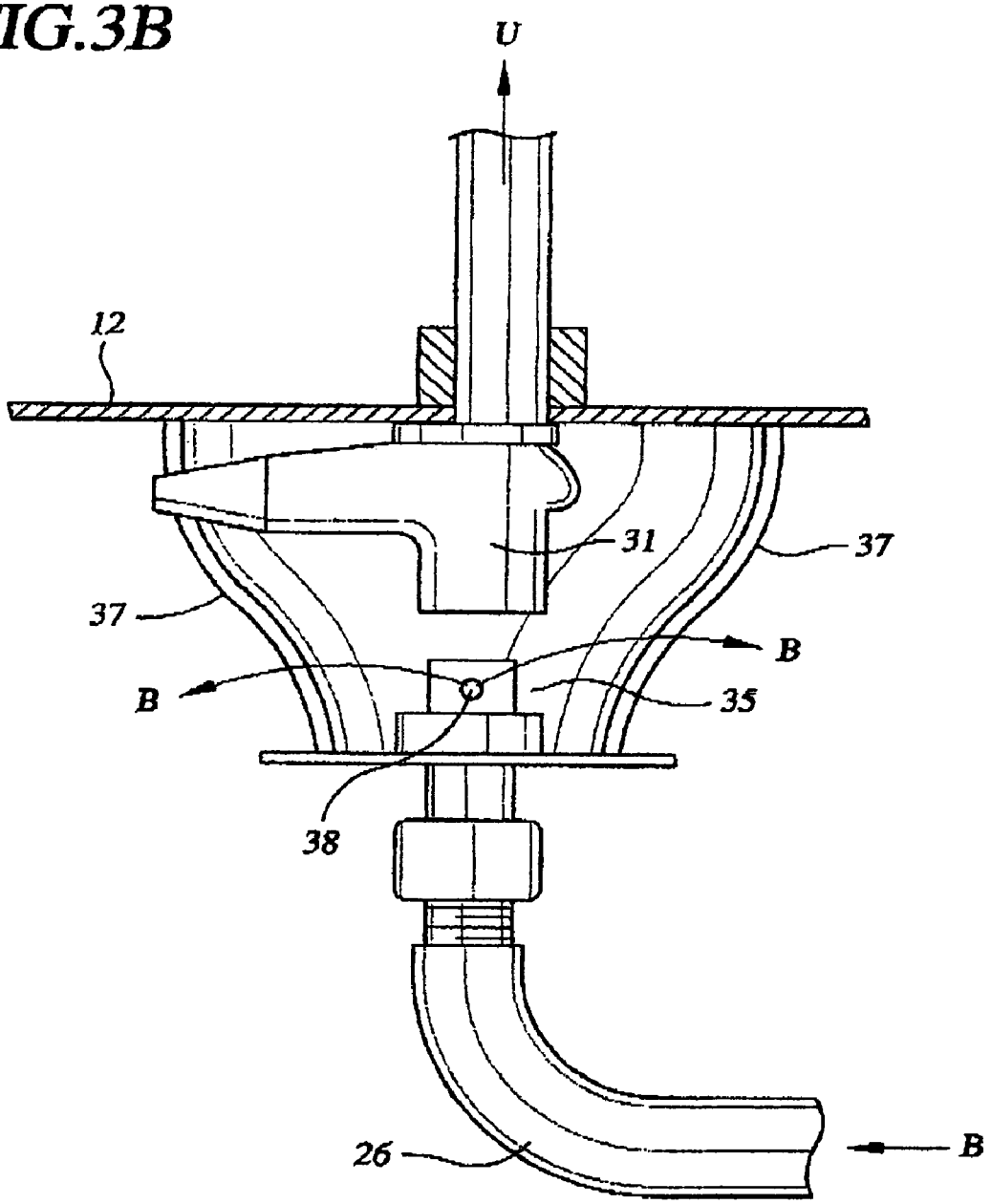
FIG. 3B is a view illustrating operation of the controller of FIG. 3A.

Alternatively, to avoid the need for control at the connection of the hose 26 to the pressure source, the controller 30 of FIGS. 3A and 3B can be employed.

The controller 30 has an outlet nozzle 31 which surrounds a channeled inlet member 32 that extends upwardly a short distance into the steering column 33 of the craft through the flat bottom 12. A retention bushing 23 in contact with the flat bottom 12 surrounds the steering column 33 and holds it in place.

The outlet nozzle 31 has its base 34 surrounding a tubular outlet member 35, which is held against the nozzle 31 by a platform 36 and rods 37 connected to the bottom 12. During propulsion of the craft 10, air flow A produces a jet sound and a visual display of exhaust bubbles.

In order to terminate propulsion without the need for shutting water from the source (not shown), the controller 30 is elevated by upward pull and water pressure on the steering column 33 as shown in FIG. 3B and indicated by the arrow U. This allows the source water to exit though the aperture 38 of the outlet member 35 and prevents any further operation of the nozzle 31. When the steering column is pushed downwardly so that the base 34 of the nozzle 31 surround the outlet member 35, the prior operation of FIG. 3A is resumed.

Propulsion of the watercraft 10 from a water pressure source is desirable when the watercraft is in use in limited areas. However the sound and bubble producing effects of the invention may be realized where the propulsion of the watercraft is by wind or mechanically. In all cases the moving flow of water through the nozzle 21 or 31 can cause air flow from the outlet O of the channeled member 21 or 31.

Figure 4A:
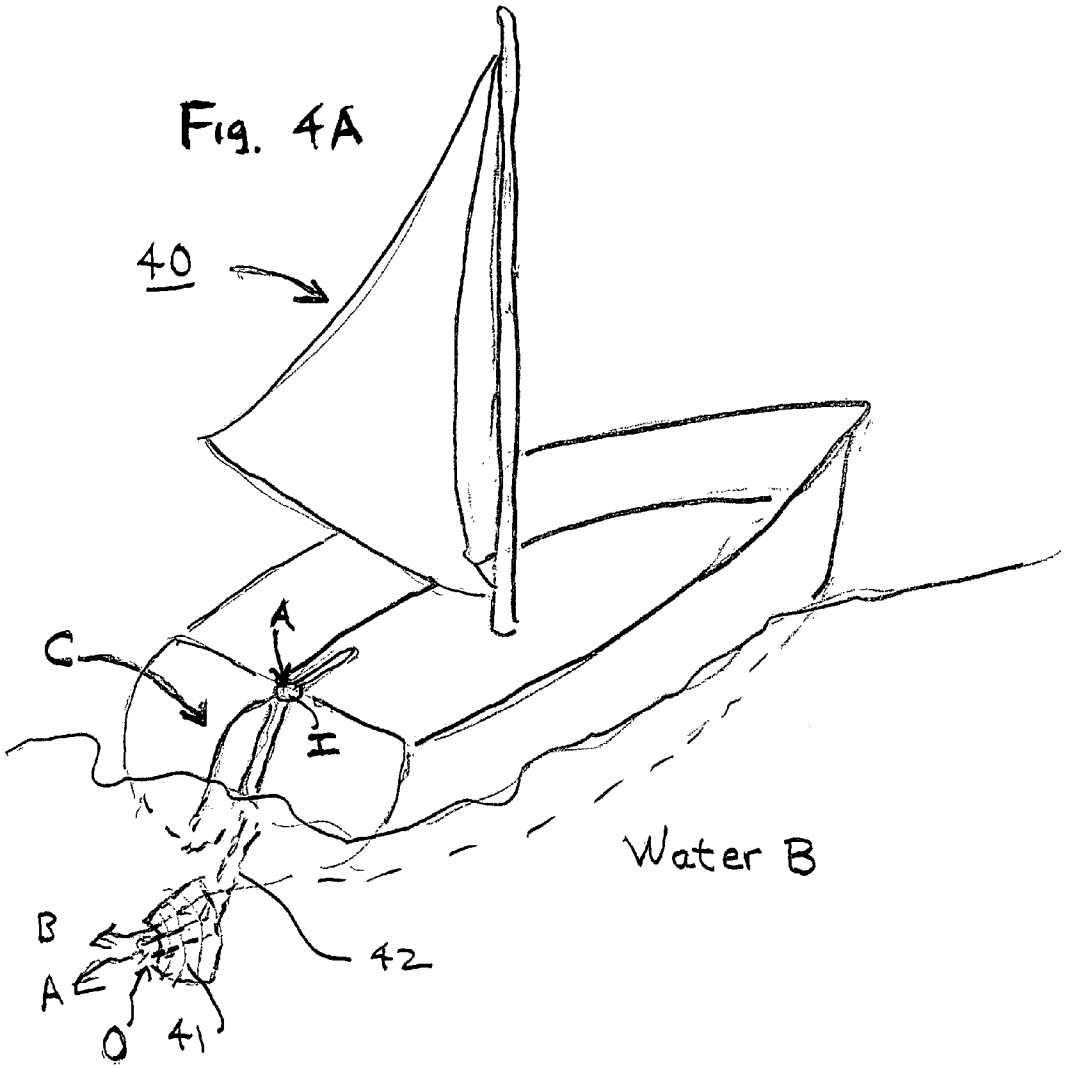
FIG. 4A is a diagram of a wind propulsion system for the practice of the invention.

As shown for the sailboat 40 of FIG. 4A, the channeled member 42 can be incorporated in the tiller control C and extend downwardly into the water below the rudder R. In addition, since wind power can propel the sailboat 40 the outlet nozzle 41, as shown in FIG. 4B takes the form of a venturi to increase the rate of outflow B in the vicinity of the channeled member outlet O, producing air flow A that creates air bubbles and a jet sound in the water.

To increase air flow from the outlet O, the end has an upwardly extending flair 44, which is advantageous even when a venturi is not used for the nozzle 41 because the flow of water B through the nozzle is sufficient to produce the partial vacuum that draw air out of the channeled member 42.

Figures 4B, 5A, 5B:
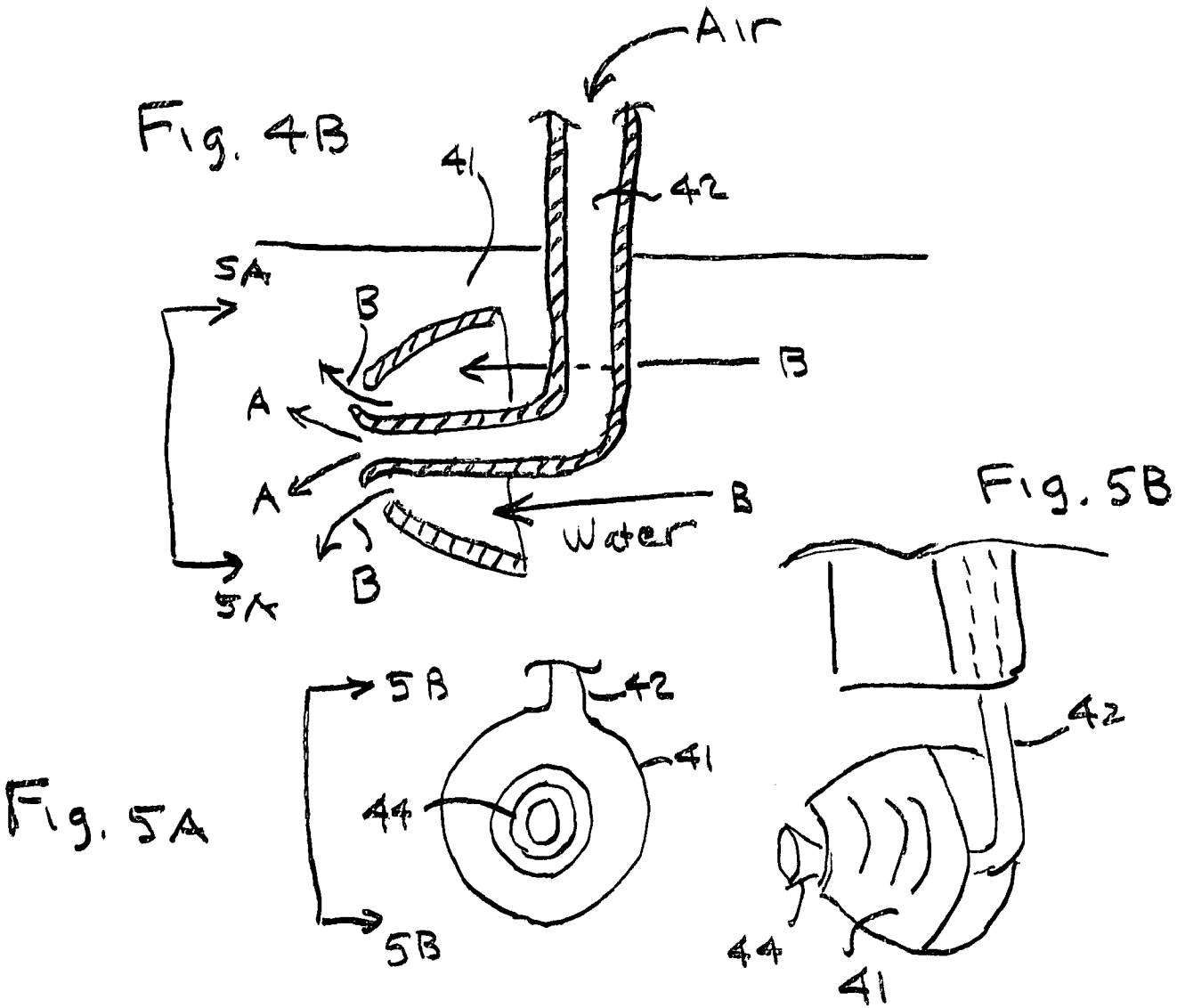
FIG. 4B is a cross sectional view of the controller for the wind propulsion system of FIG. 4A.
FIG. 5A is a partial end view of the controller of FIGS. 4A and 4B taken along thje lines 5A—5A of FIG. 4B.
FIG. 5B is a partial side view of the controller taken along the lines 5B—5B of FIG. 5A.

Frontal and side views of the nozzle venturi 41 are shown in respective FIGS. 5A and 5B. While the channeled member 42 has its output section disposed orthogonally at a right angle with respect to its input section, other angular dispositions may also be used. In addition the channeled member 42 may take a wide variety of other forms and location, being either a separate member or incorporated into other functioning members of the watercraft.

It will be understood that the foregoing detailed description is illustrative only and that modifications and adaptations may be made without departing from the spirit and scope of the invention as defined by the appended claims.

What is claimed:

1. A method of producing a sound effect, comprising the steps of (a) providing a channeled member having an air inlet and an outlet;

(b) associating, with said channeled member, means for causing air from said inlet to escape from said outlet when said outlet is immersed in a body of water (c) immersing said outlet of said channeled member in said body of water with said air inlet exposed above said body of water; and d) propelling said channeled member with said outlet immersed in said body of water.

2. The method as defined in claim 1, further including the step of propelling said channeled member by wind power.

3. The method as defined in claim 1, further including the step of propelling said channeled member by aquatic power.

4. The method as defined in claim 1, further including the step of propelling said channeled member by mechanical power.

5. The method as defined in claim 1, further including the step of orthoginally positioning said outlet in the form of a tube in relation to said inlet.

6. The method as defined in claim 1, further including the step of flaring the end of said outlet.

7. The method as defined in claim 1 further including the step of forming a venturi with respect to said outlet.

8. The method as defined in claim 7, further including the step of surrounding said outlet by said venturi.

9. The method as defined in claim 1 further including the step of reducing the water pressure at said outlet.

10. A method of producing a bubble effect comprising the steps of (a) providing a channeled member having an air inlet and an outlet;

(b) associating, with said channeled member, means for causing air from said inlet to escape from said outlet in the form of bubbles when said outlet is immersed in a body of water with said air inlet above said body of water;

(c) immersing said outlet of said channeled member in said body of water with said inlet exposed; and (d) propelling said channeled member with said outlet immersed in said body of water and said inlet exposed.

11. Apparatus comprising a channeled member having an air inlet and outlet immersible in a body of water; means associated with said channeled member for causing air from said inlet to escape from said outlet when immersed in said body of water; and means for permitting said channeled member to be propelled with said outlet immersed in said body of water; wherein said channeled member is a tube extending from the interior of a watercraft through a bottom thereof and said means associated with said channeled member surrounds said outlet member for causing air from said inlet to escape from said out let when immersed in said body of water.

12. Apparatus comprising a channeled member having an air inlet and outlet immersible in a body of water: means associated with said channeled member for causing atmospheric air from said inlet to escape from said outlet when immersed in said body of water: and means for permitting said channeled member to be propelled with said outlet immersed in said body of water, wherein said means associated with said channeled member produces a vacuum effect for causing air from said inlet to escape from said outlet when immersed in said body of water.

13. Apparatus as defined in claim 12, wherein said channeled member is in the form of a bent tube with said outlet angularly positioned in relation to said inlet.

14. Apparatus as defined in claim 12, wherein said channeled member is in the form of a bent tube with said outlet orthogonally positioned in relation to said inlet.

15. Apparatus as defined in claim 12, wherein said means for permitting said channeled member to be propelled with said outlet immersed in said body of water comprises a source of pressure applied from an aquatic source.

16. Apparatus as defined in claim 6, wherein said pressure from said aquatic source is provided by the movement of said channeled member through said body of water.

17. Apparatus as defined in claim 16, wherein said movement of said channeled member through said body of water is provided by wind power.

18. Apparatus as defined in claim 16, wherein said movement of said channeled member through said body of water is provided by aquatic power.

19. Apparatus as defined in claim 16, wherein said movement of said channeled member through said body of water is provided by engine power.

* * * * *